US007547217B1

(12) United States Patent
Lin

(10) Patent No.: US 7,547,217 B1
(45) Date of Patent: Jun. 16, 2009

(54) STRUCTURE OF ELECTRICAL CONNECTOR

(75) Inventor: Hung-Chao Lin, Chunglee (TW)

(73) Assignee: U.D. Electronic Corp., Taoyuan County (TW)

( * ) Notice: Subject to any disclaimer, the term of this patent is extended or adjusted under 35 U.S.C. 154(b) by 0 days.

(21) Appl. No.: 12/209,214

(22) Filed: Sep. 12, 2008

(51) Int. Cl.
*H01R 12/00* (2006.01)

(52) U.S. Cl. ..... 439/76.1; 439/607; 439/92

(58) Field of Classification Search ..... 439/607, 439/79, 76.1, 78, 92, 108
See application file for complete search history.

(56) References Cited

U.S. PATENT DOCUMENTS 5,087,210 A * 2/1992 Myers et al. ..... 439/425
5,228,872 A * 7/1993 Liu ..... 439/607
5,340,333 A * 8/1994 Schroth ..... 439/607
5,547,397 A * 8/1996 Hirai ..... 439/607
5,599,207 A * 2/1997 Lai ..... 439/567
5,688,145 A * 11/1997 Liu ..... 439/607

* cited by examiner

*Primary Examiner*—Khiem Nguyen

(57) ABSTRACT

An electrical connector includes an electrically insulative housing that has a rear accommodation space, a front receiving unit for receiving a matching electrical connector, terminal slots formed in the front receiving unit and extended to the rear accommodation space and recessed locating portions symmetrically disposed at two opposite lateral sides, a circuit board mounted in the rear accommodation space of the housing and having signal terminals extended from the front side thereof and respectively inserted into the terminal slots of the housing and suspending in the front receiving unit of the housing, an adapter module fastened to the rear bottom side of the circuit board and carrying a plurality of input terminals that have the respective front connection portions respectively electrically connected to the metal contacts of the circuit board and the respective rear bonding portions downwardly extending out of the bottom wall of the adapter module for bonding to an external circuit board, grounding spring plates respectively mounted in the recessed locating portions of the housing and bonded to the circuit board for grounding, and a metal shield surrounding the housing and the adapter board and kept in positive contact with the grounding spring plates for grounding.

5 Claims, 6 Drawing Sheets

STRUCTURE OF ELECTRICAL CONNECTOR

This application claims the priority benefit of Taiwan patent application number 096215544 filed on Sep. 14, 2007.

BACKGROUND OF THE INVENTION

1. Field of the Invention

The present invention relates to electrical connectors and more particularly, to an improved structure of electrical connector, which has grounding spring plates mounted in recessed locating portions at two opposite sides of the electrically insulative housing and bonded to the circuit board that is mounted in a rear accommodation space in the rear side of the electrically insulative housing for grounding to avoid electromagnetic wave interference.

2. Description of the Related Art

Following fast development of computer technology, versatile desktop computers as well as notebook computers have been continuously created. These advanced computers have the characteristics of strong computing function, fast operating speed, small size and high transmission speed. The most popularly used USA connectors include two types, i.e., the type of transmission speed at 1.5 Mbps and the type of transmission speed at 12 Mbps. These two transmission speeds are faster than the parallel ports or serial ports that are currently used in computers. Therefore, the use of USB connectors in a computer greatly improves the transmission efficiency between the computer and the related peripheral equipments such as keyboard, mouse, modem, joystick, scanner and etc.

To fit the developing tendency of computer toward a small-sized design, electrical connectors for computer must be relatively small-sized. However, the problem of electromagnetic interference must be taken into account when designing a small-sized electrical connector for computer. Signal interference of an electrical connector may come from external electromagnetic waves or the inside noises. During operation of an electrical connector, external electromagnetic waves from an external transmission line may interfere with the transmission of power supply or signal in the electrical connector, and this interference may affect the surrounding electronic components or circuits, causing a signal transmission error or failure or affecting the signal transmission quality of the electrical connector.

Therefore, filter means is usually used for suppressing electromagnetic interference, maintaining signal integrity. A filter device for this purpose is usually installed in a circuit board inside the host. However, the installation of a filter device in a circuit board is complicated and requirements much installation space. Some suppliers have the electrically insulative housing of each the provided electrical connector be surrounded with a metal shield, which has spring strips for contacting or bonding to the circuit board in the electrically insulative housing for connecting to external metal object for grounding. The spring strips may be formed of a part of the metal shield through a stamping technique. This spring strip formation procedure complicates the fabrication of the metal shield and wastes much the metal material. A filter module and/or grounding terminals may be installed in the circuit board inside the electrically insulative housing of an electrical connector to eliminate the interference of noises. However, the arrangement of filter module and/or grounding terminals complicates the circuit layout of the electrical connector. Further, arranging multiple grounding terminals and signal terminals in the limited surface area of a circuit board for electrical connector may cause electromagnetic interference among the terminals, lowering signal transmission stability and the shielding effect of the metal shield.

SUMMARY OF THE INVENTION

The present invention has been accomplished under the circumstances in view. It is therefore one object of the present invention to provide an improved structure of electrical connector, which effectively eliminates electromagnetic wave interference and improves signal transmission stability. It is another object of the present invention to provide an improved structure of electrical connector, which saves much installation space and manufacturing cost.

According to one aspect of the present invention, the electrical connector is comprised of an electrically insulative housing, a circuit board, an adapter module, grounding spring plates and a metal shield. The electrically insulative housing comprises a rear accommodation space, a front receiving unit for receiving a matching electrical connector, terminal slots formed in the front receiving unit and extended to the rear accommodation space, and recessed locating portions symmetrically disposed at two opposite lateral sides. The circuit board is mounted in the rear accommodation space of the electrically insulative housing, having signal terminals extended from the front side thereof and respectively inserted into the terminal slots of the electrically insulative housing and suspending in the front receiving unit of the electrically insulative housing. The adapter module is fastened to the rear bottom side of the circuit board and carrying a plurality of input terminals. The input terminals have the respective front connection portions respectively electrically connected to the metal contacts of the circuit board and the respective rear bonding portions downwardly extending out of the bottom wall of the adapter module for bonding to an external circuit board. The grounding spring plates are respectively mounted in the recessed locating portions of the electrically insulative housing and bonded to the circuit board for grounding. The metal shield surrounds the housing and the adapter board and kept in positive contact with the grounding spring plates for grounding.

According to another aspect of the present invention, the circuit board is provided with at least one passive component, filter, surge arrester or any other grounding or EMI protection component to effective remove noises from the transmitting signal, avoiding damage.

DETAILED DESCRIPTION OF THE PREFERRED EMBODIMENT

Figure 1:
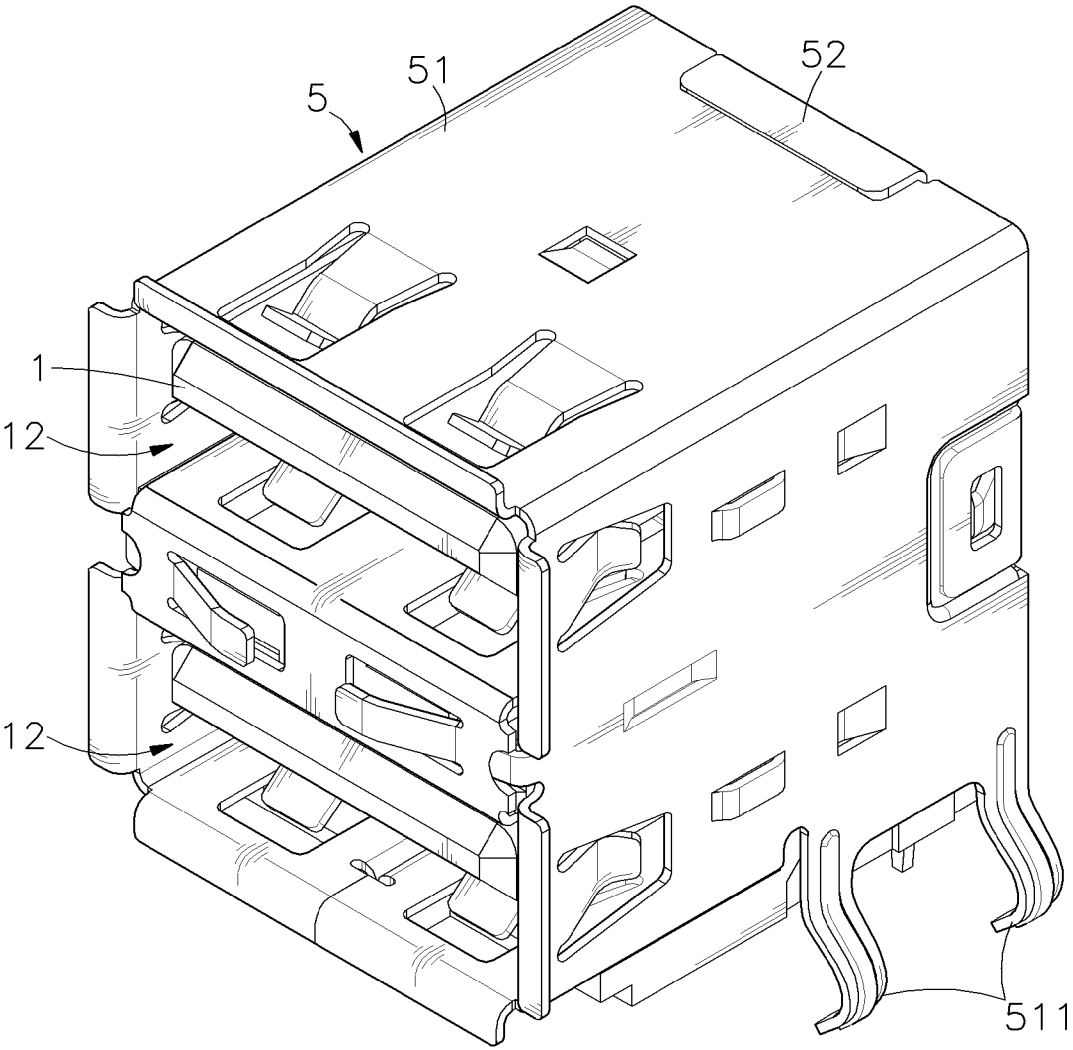
FIG. 1 is an elevational view of an electrical connector according to the present invention.
Figure 2:
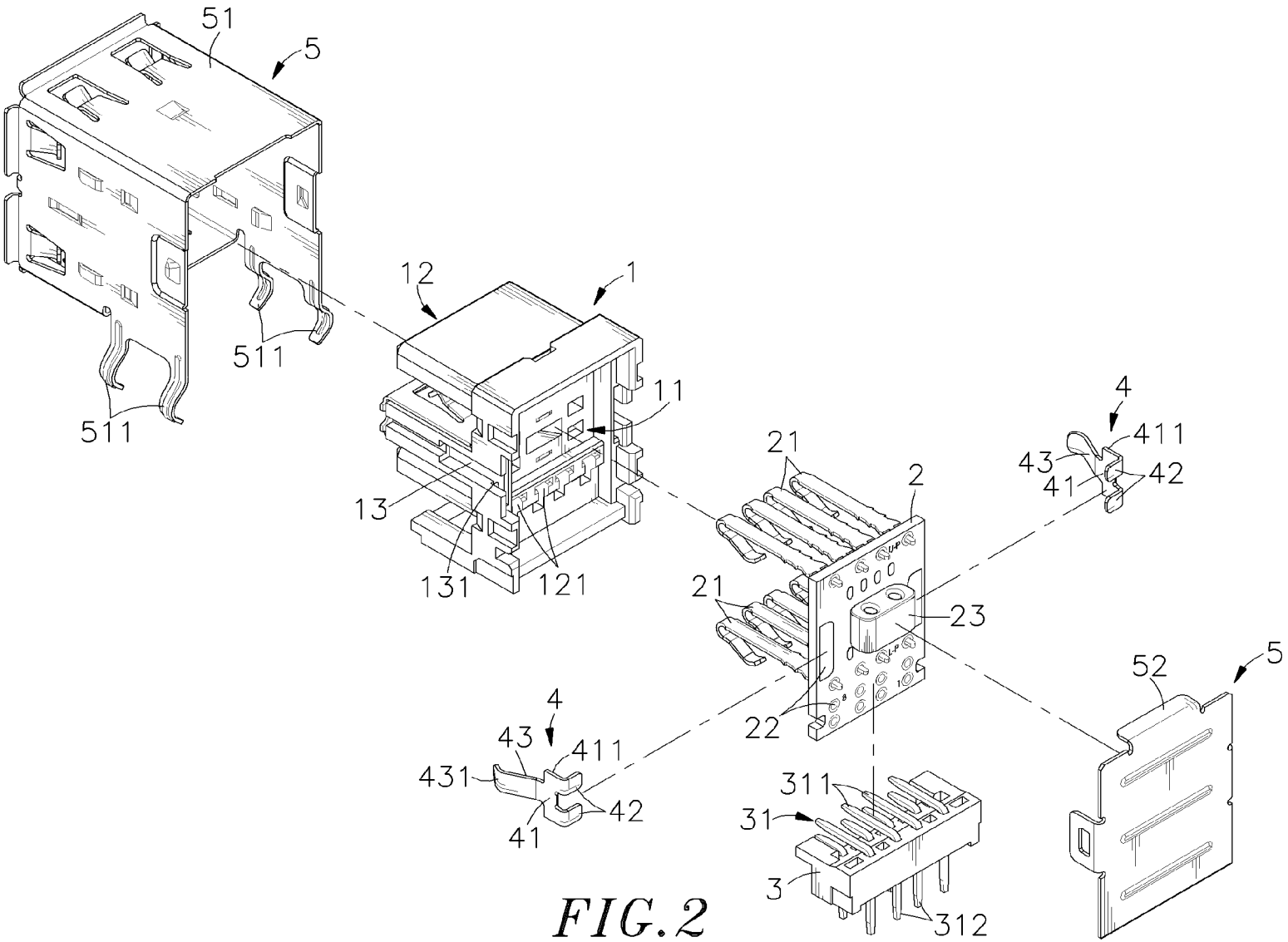
FIG. 2 is an exploded view of the electrical connector according to the present invention.
Figure 3:
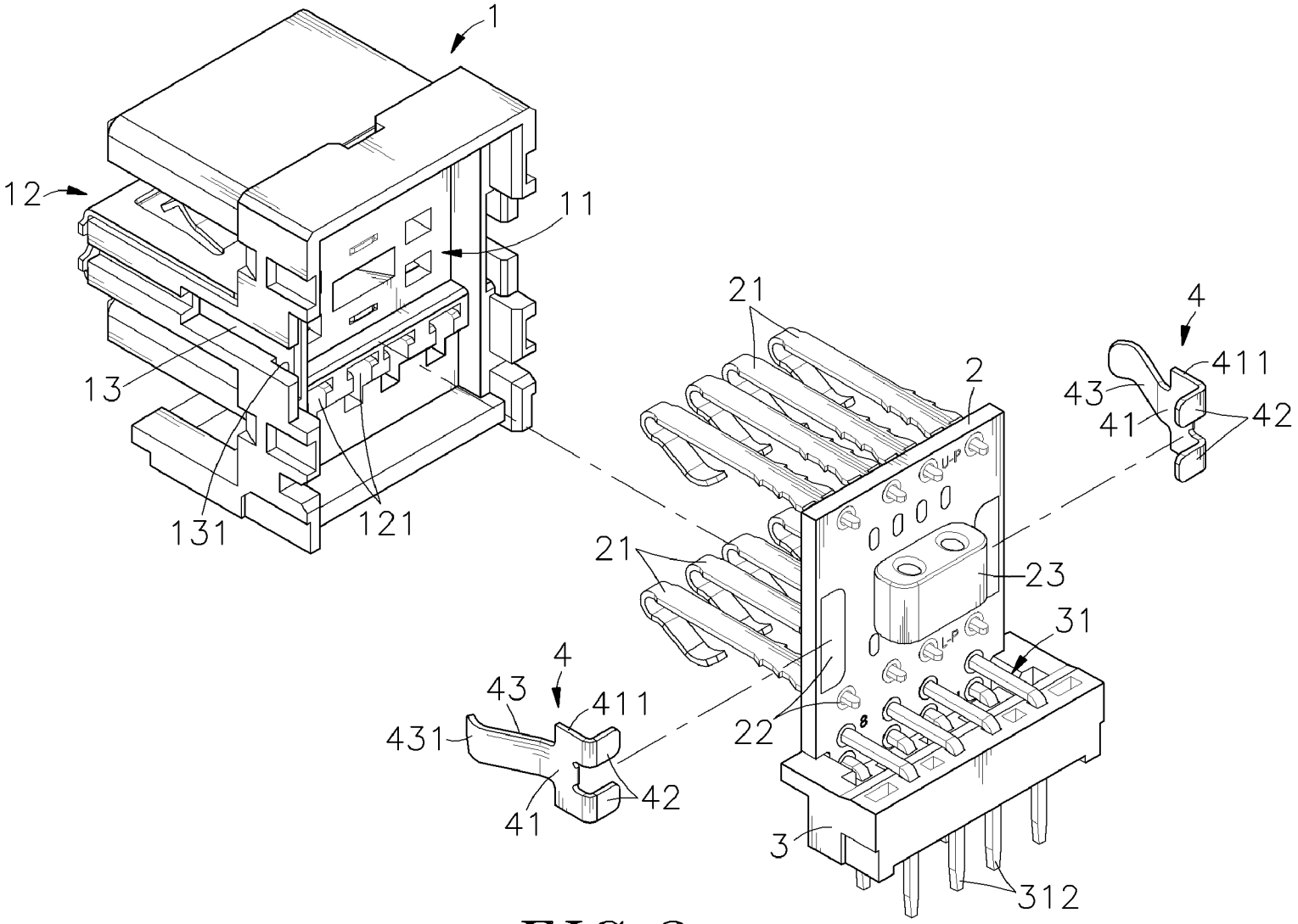
FIG. 3 is an enlarged view of a part of FIG. 2.

Referring to FIGS. 1~3, an electrical connector in accordance with the present invention is shown comprised of an electrically insulative housing 1, a circuit board 2, an adapter module 3, a plurality of, for example, two grounding spring plates 4 and a metal shield 5.

The electrically insulative housing 1 comprises a rear accommodation space 11 defined in a rear side thereof, a front receiving unit 12 disposed at a front side thereof for receiving a matching electrical connector (not shown), a plurality of terminal slots 121 formed in the front receiving unit 12 and backwardly extending to the rear accommodation space 11, two recessed locating portions 13 symmetrically disposed at two opposite lateral sides thereof, and two mounting grooves 131 respectively backwardly extending from the recessed locating portions 13 to the rear side.

The circuit board 2 is mountable in the rear accommodation space 11 of the electrically insulative housing 1, comprising a plurality of signal terminals 21 forwardly extending from a front side thereof and a plurality of metal contacts 22 disposed at a back side thereof.

The adapter module 3 is provided at the rear bottom side of the circuit board 2, comprising a plurality of input terminals 31 respectively embedded therein at predetermined locations, each having a front connection portion 311 extending out of the top wall thereof for connection to the metal contacts 22 of the circuit board 2 respectively and a rear bonding portion 312 downwardly extending out of the bottom wall thereof for bonding to a predetermined external circuit board (not shown).

The two grounding spring plates 4 are adapted for mounting in the recessed locating portions 13 of the electrically insulative housing 1, each comprising a base 41, two shoulders 411 respectively extended from two opposite lateral sides of the base 41 and respectively terminating in a respective bonding portion 42, and a spring arm 43 forwardly extending from the front side of the base 41 and terminating in an arched contact portion 431.

The metal shield 5 is adapted for surrounding the electrically insulative housing 1, comprising a front metal shell 51 and a rear metal shell 52. The front metal shell 51 comprises a plurality of mounting legs 511 bilaterally downwardly extending from the bottom side thereof for fastening to a predetermined external circuit board.

Figure 4:
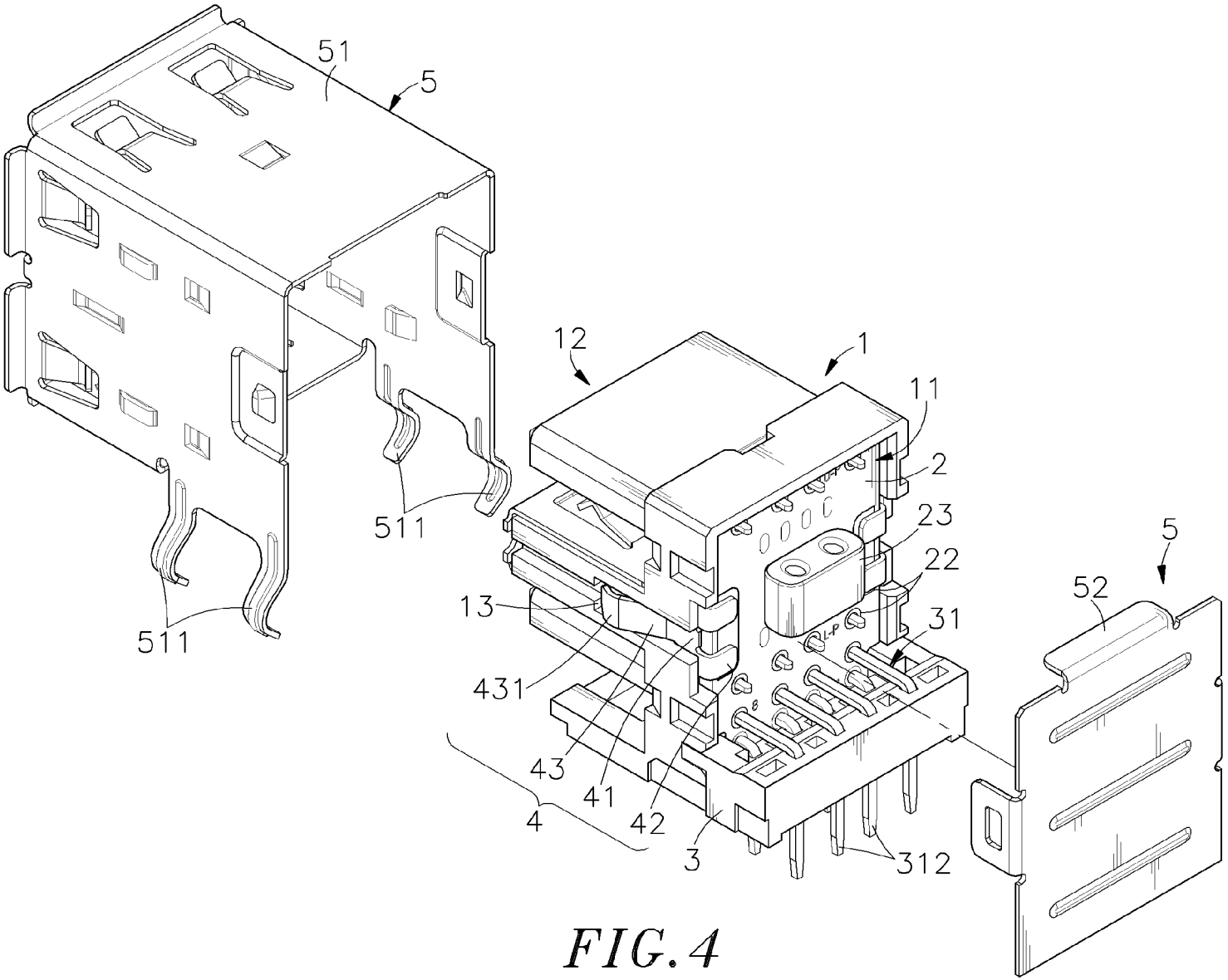
FIG. 4 is a schematic drawing of the present invention, showing the electrically insulative housing, the circuit board, the adapter module and the grounding spring plates assembled before mounting of the front metal shell and rear metal shell of the metal shield.
Figure 5:
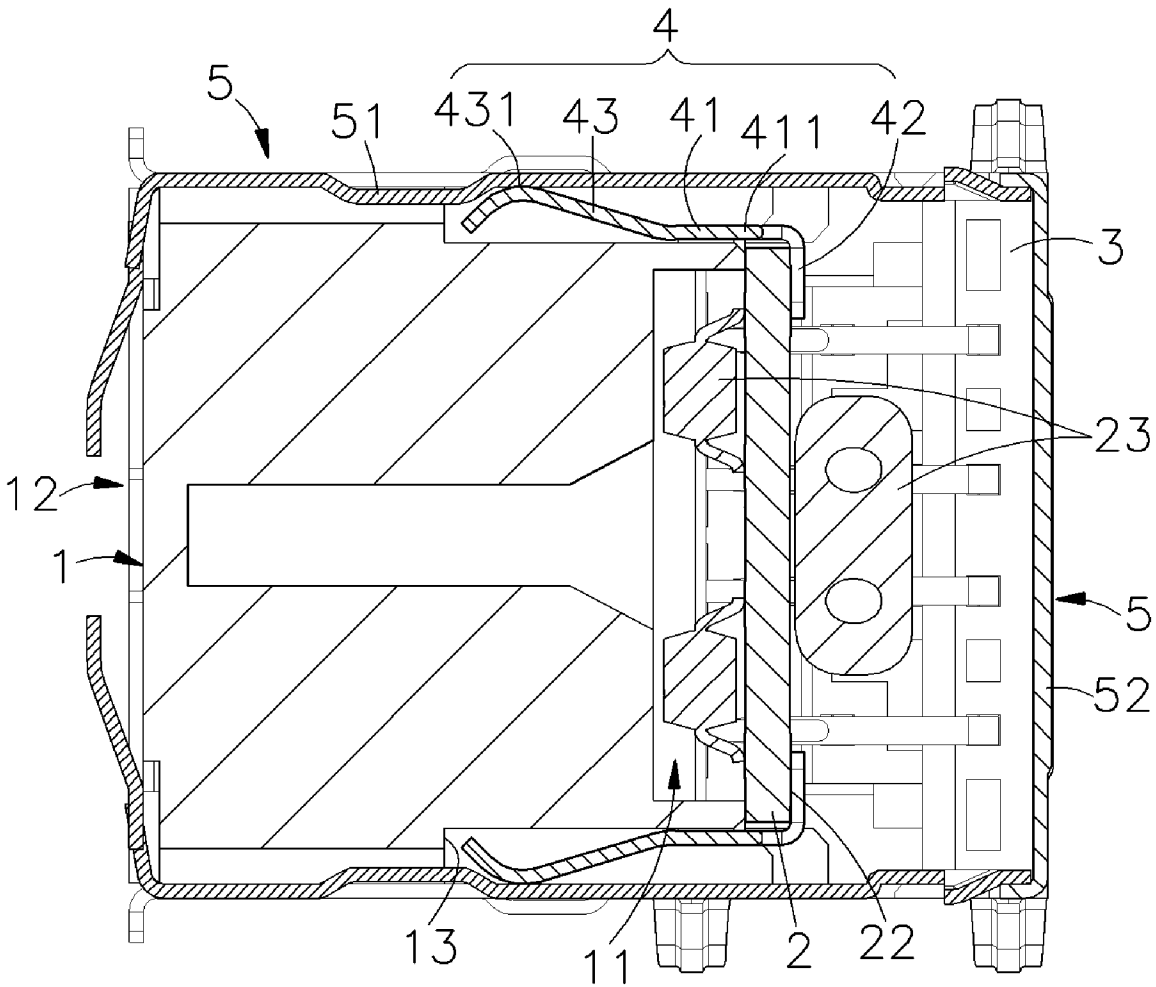
FIG. 5 is a sectional top view of the electrical connector according to the present invention.
Figure 6:
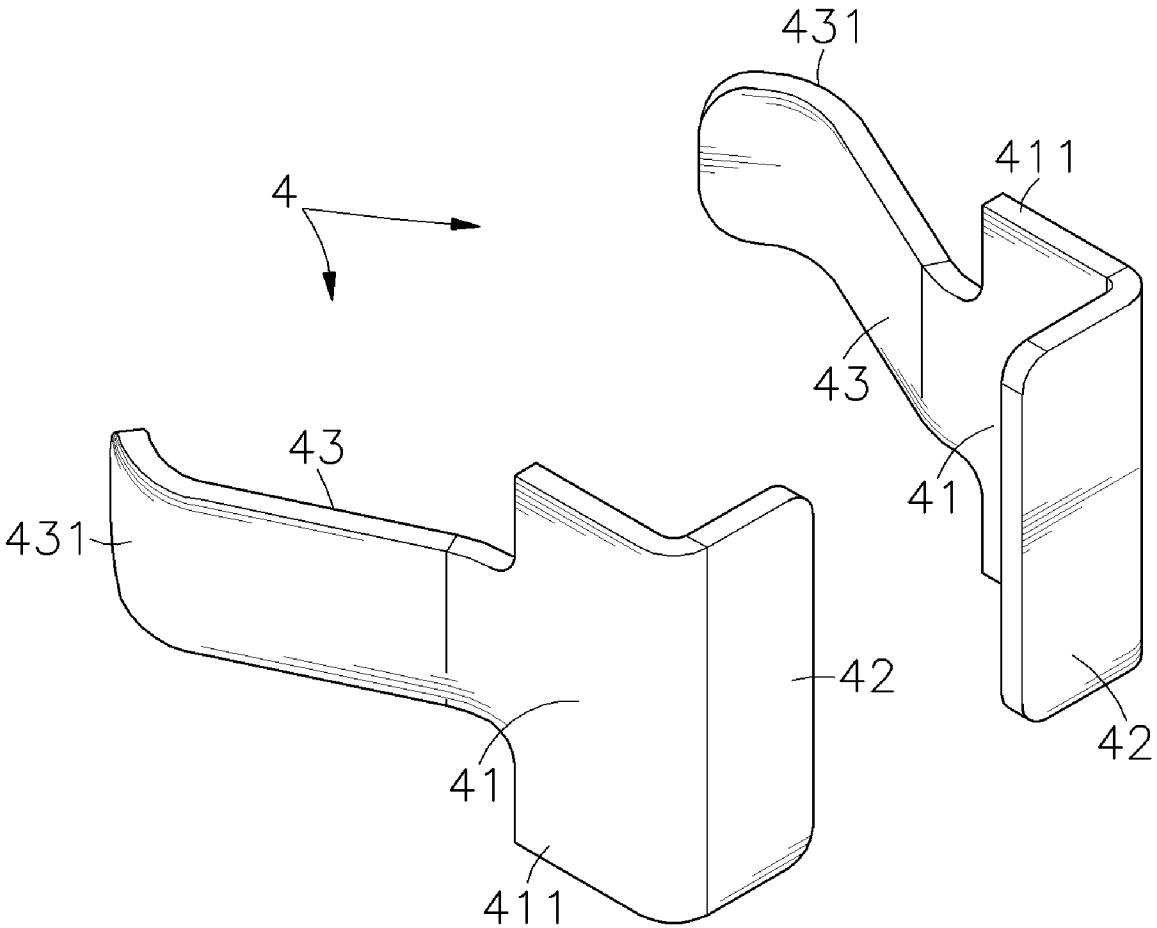
FIG. 6 is an elevational view of an alternate form of the grounding spring plates according to the present invention.

Referring to FIGS. 4~6 and FIG. 3 again, during installation, the adapter module 3 is fastened to rear bottom side of the circuit board 2 to have the front connection portions 311 of the input terminals 31 be respectively electrically connected to the corresponding metal contacts 22 at the circuit board 2 and the rear bonding portions 312 of the input terminals 31 be respectively electrically bonded to the predetermined external circuit board (not shown), and then the bonding portions 42 of the two grounding spring plates 4 are respectively electrically connected to the corresponding metal contacts 22 at the circuit board 2, and then the circuit board 2 with the adapter module 3 and the grounding spring plates 4 are set in the rear accommodation space 11 of the electrically insulative housing 1 to force the signal terminals 21 and the spring arm 43 of the grounding spring plates 4 into the terminal slots 121 and the recessed locating portions 13 of the electrically insulative housing 1 respectively so as to further have the signal terminals 21 be suspending in the front receiving unit 12 for the contact of respective contact terminals of the matching electrical connector (not shown). At this time, the spring arm 43 of the grounding spring plates 4 are respectively inserted into the recessed locating portions 13 of the electrically insulative housing 1 to have the respective arched contact portions 431 be respectively exposed to the out side of the respective recessed locating portions 13, and the shoulders 411 of the grounding spring plates 4 are respectively engaged into the two mounting grooves 131 of the electrically insulative housing 1. By means of the aforesaid arrangement, electronic device or devices 23 can be installed in the back side of the circuit board 2, saving much the space of the predetermined circuit board at the host (not shown).

When the electrically insulative housing 1, the circuit board 2, the adapter module 3 and the grounding spring plates 4 are assembled, the front metal shell 51 of the metal shield 5 is capped onto the electrically insulative housing 1 to have the two opposite vertical lateral sidewalls thereof be respectively forced against the arched contact portions 431 of the grounding spring plates 4, and then the rear metal shell 52 is covered over the circuit board 2 and the adapter module 3 and fastened to the rear open side of the front metal shell 51, and then the mounting legs 511 of the front metal shell 51 of the metal shield 5 are fastened to the predetermined circuit board at the host (not shown) and grounded. After installation, the metal shield 5 surrounds the electrically insulative housing 1, the grounding terminals of the circuit board 2 are electrically connect the grounding terminals of the predetermined circuit board at the host (not shown) through the grounding spring plates 4 and the front metal shell 51 of the metal shield 5.

FIG. 6 shows an alternate form of the grounding spring plates 4. According to this alternate form, each grounding spring plate 4 has only one single bonding portion 42 that is formed integral with the base 41 and the shoulders 411.

Further, the bonding portions 42 of the grounding spring plates 4 can be electrically connected to the respective metal contacts 22 at the circuit board 2 through surface mount technology or by means of friction contact. Alternatively, the metal contacts 22 can be via holes for the bonding of the bonding portions 42 of the grounding spring plates 4. Further, the electronic device or devices 23 each can be a resistor, capacitor or any other passive component, or a filter, surge arrester or any other grounding or EMI protection component to effective remove noises from the transmitting signal, avoiding damage. Further, the arrangement of the electronic device or devices 23 on the back side of the circuit board 2 saves much installation space When compared to prior art designs, the improved structure of electrical connector according to the present invention has the following advantages:

At first, the electrically insulative housing 1 has two recessed locating portions 13 symmetrically disposed at two opposite lateral sides thereof and two mounting grooves 131 respectively backwardly extending from the recessed locating portions 13 to the rear side for securing the two grounding spring plates 4 that have the respective bonding portions 42 respectively and electrically connected to the respective metal contacts 22 at the circuit board 2, and therefore the grounding spring plates 4 secure the circuit board 2 firmly in the rear accommodation space 11 of the electrically insulative housing 1 while grounding the circuit board 2.

At the second place, when capping the front metal shell 51 of the metal shield 5 onto the electrically insulative housing 1, the two opposite vertical lateral sidewalls of the front metal shell 51 are respectively forced against the arched contact portions 431 of the grounding spring plates 4, assuring positive contact between the metal shield 5 and the grounding spring plates 4 for grounding.

At the third place, the bonding portions 42 of the grounding spring plates 4 can be electrically connected to the respective metal contacts 22 at the circuit board 2 through surface mount technology, through-hole technique or friction contact technique to have the circuit board 2 be grounded through the front metal shell 51 of the metal shield 5 for protection against interference of noises and electromagnetic wave interference.

At the fourth place, the grounding spring plates 4 can be directly made of a metal sheet through a stamping technique, saving the cost.

At last, the grounding spring plates 4 works as grounding components of the circuit board 2 to protect the signal terminals 21 of the circuit board 2 and the input terminals 31 of the adapter module 3 against electromagnetic wave interference. Further, the arrangement of the grounding spring plates 4 simplifies the circuit layout of the circuit board 2, saving much the installation space.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

an electrically insulative housing, said electrically insulative housing comprising a rear accommodation space defined in a rear side thereof, a front receiving unit disposed at a front side thereof for receiving a matching electrical connector, a plurality of terminal slots formed in said front receiving unit and backwardly extending to said rear accommodation space, and a plurality of recessed locating portions symmetrically disposed at two opposite lateral sides thereof;

a circuit board mounted in the rear accommodation space of said electrically insulative housing, said circuit board comprising a plurality of signal terminals forwardly extending from a front side thereof and respectively inserted into said terminal slots of said electrically insulative housing and suspending in said front receiving unit of said electrically insulative housing, and a plurality of signal metal contacts and grounding metal contacts disposed at a back side thereof, said signal metal contacts being respectively electrically connected with said signal terminals;

an adapter module fastened to a rear bottom side of said circuit board, said adapter module comprising a plurality of input terminals respectively embedded therein at predetermined locations, said input terminals each having a front connection portion extending out of a top wall of said adapter module and respectively electrically connected to the metal contacts of said circuit board and a rear bonding portion downwardly extending out of a bottom wall of said adapter module for bonding to a predetermined external circuit board;

a plurality of grounding spring plates respectively mounted in the recessed locating portions of said electrically insulative housing, each said grounding spring plate comprising a base, at least one bonding portion backwardly extending from said base and electrically connected to one metal contact of said circuit board for grounding and a spring arm forwardly extending from a front side of said base; and a metal shield surrounding said electrically insulative housing and said adapter module and said grounding spring plates and kept in contact with said grounding spring plates for grounding.

2. The electrical connector as claimed in claim 1, wherein said electrically insulative housing further comprises a plurality of mounting grooves respectively backwardly extending from said recessed locating portions; each said metal spring plate further comprises two shoulders respectively protruded from said base and respectively engaged into the mounting groove of the associating recessed locating portion of said electrically insulative housing.

3. The electrical connector as claimed in claim 1, wherein the bonding portions of said grounding spring plate are respectively electrically connected to the respective metal contacts of said circuit board through one of the methods of surface-mounting technology, through-hole technique and friction contact technique.

4. The electrical connector as claimed in claim 1, wherein the spring arm of each said metal spring plate has a free end terminating in an arched contact portion.

5. The electrical connector as claimed in claim 1, wherein said metal shield comprises a front metal shell capped on said electrically insulative housing and kept in positive contact with said grounding spring plates, and a rear metal shell fastened to a rear open side of said front metal shell and covered over said circuit board and said adapter module, said front metal shell comprising a plurality of mounting legs bilaterally downwardly extending from a bottom side thereof for fastening to an external circuit board.

* * * * *